US007458506B2

(12) United States Patent
Fujioka

(10) Patent No.: US 7,458,506 B2
(45) Date of Patent: Dec. 2, 2008

(54) PAPER MONEY HANDLING MACHINE

(75) Inventor: Tshinori Fujioka, Owariasahi (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 599 days.

(21) Appl. No.: 11/138,374

(22) Filed: May 27, 2005

(65) Prior Publication Data

US 2006/0043167 A1 Mar. 2, 2006

(30) Foreign Application Priority Data

Sep. 2, 2004 (JP) ..... 2004-255327

(51) Int. Cl.
*G07F 19/00* (2006.01)

(52) U.S. Cl. ..... 235/379; 235/381; 235/380; 235/492; 902/8; 902/11; 902/26

(58) Field of Classification Search ..... 902/8, 902/11, 26; 235/379
See application file for complete search history.

(56) References Cited

U.S. PATENT DOCUMENTS

| | | | | |
|---|---|---|---|---|
| 5,478,992 | A | 12/1995 | Hamada et al. | |
| 6,547,151 | B1 * | 4/2003 | Baldi | 235/492 |
| 6,550,671 | B1 | 4/2003 | Brown | |
| 6,918,535 | B1 * | 7/2005 | Brosow | 235/379 |
| 7,004,385 | B1 * | 2/2006 | Douglass | 235/379 |
| 7,032,828 | B2 * | 4/2006 | Krul et al. | 235/492 |
| 7,249,709 | B2 * | 7/2007 | Van Rens | 235/379 |
| 7,284,692 | B1 * | 10/2007 | Douglass | 235/379 |
| 2003/0006121 | A1 * | 1/2003 | Lee et al. | 194/206 |
| 2003/0210386 | A1 * | 11/2003 | Laskowski | 356/71 |
| 2004/0260650 | A1 * | 12/2004 | Nagaya et al. | 705/43 |
| 2005/0150740 | A1 * | 7/2005 | Finkenzeller et al. | 194/207 |

FOREIGN PATENT DOCUMENTS

| | | |
|---|---|---|
| DE | 101 07 344 | 10/2001 |
| DE | 101 63 267 | 7/2003 |
| EP | 1 280 089 | 1/2003 |
| EP | 1 437 692 | 7/2004 |
| JP | 2001-260580 | 9/2001 |
| JP | 2003-178185 | 6/2003 |
| JP | 2004-164156 | 6/2004 |
| WO | WO 03/054808 | 7/2003 |

* cited by examiner

*Primary Examiner*—Michael G Lee
*Assistant Examiner*—Kristy A Haupt
(74) *Attorney, Agent, or Firm*—Antonelli, Terry, Stout & Kraus, LLP.

(57) ABSTRACT

A bill handling apparatus, such as an ATM, for handling bills each having an IC chip which holds unique discriminative information includes a manipulating unit for selecting the type of transaction to be done by a customer. A controller is provided for recognizing the type of the transaction selected with the manipulating unit. A bill discriminator reads a surface information on the bills and performs true/false determination. A wireless IC reader reads discriminative information held by the IC chips of the conveyed bills. The discriminative information, result of discriminating the bills, and transaction information are searchable for tracing the bill.

13 Claims, 9 Drawing Sheets

| ID NUMBER | POSITION IN SEQUENCE | TYPE OF TRANS-ACTION | ACCOUNT NUMBER | YEAR/MONTH/DAY/HOUR/MINUTE/SECOND | FEED FROM | NO | STORE INTO | NO | VALIDATION RESULT CLASS | DENOMINATION |
|---|---|---|---|---|---|---|---|---|---|---|
| 11···001 | 1 | LOAD | – | 2004.02.05.08.20.30 | CASSETTE | C001 | ¥1000 BOX | 1001 | TRUE | ¥1000 |
| 11···001 | 4 | DISPENSE | 456789 | 2004.02.05.11.18.24 | ¥1000 BOX | 1001 | CASH SLOT | 4 | TRUE | ¥1000 |
| 11···002 | 1 | LOAD | – | 2004.02.05.08.20.31 | CASSETTE | C002 | ¥1000 BOX | 1002 | TRUE | ¥1000 |
| 11···002 | 4 | DISPENSE | 456789 | 2004.02.05.11.18.23 | ¥1000 BOX | 1002 | CASH SLOT | 3 | TRUE | ¥1000 |
| 11···003 | 1 | LOAD | – | 2004.02.05.08.20.32 | CASSETTE | C003 | ¥1000 BOX | 1003 | TRUE | ¥1000 |
| 11···003 | 4 | DISPENSE | 456789 | 2004.02.05.11.18.22 | ¥1000 BOX | 1003 | CASH SLOT | 2 | TRUE | ¥1000 |
| AA···001 | 1 | DEPOSIT | 123456 | 2004.02.05.10.15.36 | CASH SLOT | 1 | TEMPORARY STOCKER | 1 | TRUE | ¥10000 |
| AA···001 | 3 | STORE | – | 2004.02.05.10.15.49 | TEMPORARY STOCKER | 1 | ¥10000 BOX | A001 | TRUE | ¥10000 |
| AA···001 | 4 | DISPENSE | 456789 | 2004.02.05.11.18.25 | ¥10000 BOX | A001 | CASH SLOT | 5 | USABLE | ¥10000 |
| AA···002 | 1 | DEPOSIT | 123456 | 2004.02.05.10.15.37 | CASH SLOT | 2 | TEMPORARY STOCKER | 2 | TRUE | ¥10000 |
| AA···002 | 3 | STORE | – | 2004.02.05.10.15.48 | TEMPORARY STOCKER | 2 | ¥10000 BOX | A002 | DUBIOUS | ¥10000 |
| 11···004 | 1 | DEPOSIT | 123456 | 2004.02.05.10.15.38 | CASH SLOT | 3 | TEMPORARY STOCKER | 3 | TRUE | ¥1000 |
| 11···004 | 3 | STORE | – | 2004.02.05.11.15.47 | TEMPORARY STOCKER | 3 | ¥1000 BOX | 1004 | TRUE | ¥1000 |
| 11···004 | 4 | DISPENSE | 456789 | 2004.02.05.12.18.21 | ¥1000 BOX | 1004 | CASH SLOT | 1 | INCLINATION ABNOMAL | ¥1000 |
| 22···001 | 1 | DEPOSIT | 123456 | 2004.02.05.10.15.39 | CASH SLOT | 4 | TEMPORARY STOCKER | 4 | TRUE | ¥2000 |
| 22···001 | 3 | STORE | – | 2004.02.05.11.15.46 | TEMPORARY STOCKER | 4 | NON-RECYCLING BOX | H002 | TRUE | ¥2000 |
| 55···001 | 1 | DEPOSIT | 123456 | 2004.02.05.10.15.40 | CASH SLOT | 5 | TEMPORARY STOCKER | 5 | TRUE | ¥5000 |
| 55···001 | 3 | STORE | – | 2004.02.05.10.15.45 | TEMPORARY STOCKER | 5 | NON-RECYCLING BOX | H001 | TRUE | ¥5000 |

FIG. 7

| 71 | 72 | 73 | 74 | 75 | 76 | | 77 | | 78 | |
|---|---|---|---|---|---|---|---|---|---|---|
| ID NUMBER | POSITION IN SEQUENCE | TYPE OF TRANS-ACTION | ACCOUNT NUMBER | YEAR/MONTH/DAY/ HOUR/MINUTE/ SECOND | FEED FROM | | STORE INTO | | DISCRIMINATION RESULT | |
| | | | | | | NO | | NO | CLASS | DENOMINATION |
| 11···001 | 1 | LOAD | – | 2004.02.05.08.20.30 | CASSETTE | C001 | ¥1000 BOX | 1001 | TRUE | ¥1000 |
| 11···002 | 1 | LOAD | – | 2004.02.05.08.20.31 | CASSETTE | C002 | ¥1000 BOX | 1002 | TRUE | ¥1000 |
| 11···003 | 1 | LOAD | – | 2004.02.05.08.20.32 | CASSETTE | C003 | ¥1000 BOX | 1003 | TRUE | ¥1000 |
| AA···001 | 2 | DEPOSIT | 123456 | 2004.02.05.10.15.36 | CASH SLOT | 1 | TEMPORARY STOCKER | 1 | TRUE | ¥10000 |
| AA···002 | 2 | DEPOSIT | 123456 | 2004.02.05.10.15.37 | CASH SLOT | 2 | TEMPORARY STOCKER | 2 | TRUE | ¥10000 |
| 11···004 | 2 | DEPOSIT | 123456 | 2004.02.05.10.15.38 | CASH SLOT | 3 | TEMPORARY STOCKER | 3 | TRUE | ¥1000 |
| 22···001 | 2 | DEPOSIT | 123456 | 2004.02.05.10.15.39 | CASH SLOT | 4 | TEMPORARY STOCKER | 4 | TRUE | ¥2000 |
| 55···001 | 2 | DEPOSIT | 123456 | 2004.02.05.10.15.40 | CASH SLOT | 5 | TEMPORARY STOCKER | 5 | TRUE | ¥5000 |
| R0···001 | 2 | DEPOSIT | 123456 | 2004.02.05.10.15.41 | CASH SLOT | 6 | CASH SLOT | 6 | REJECT | – |
| 55···001 | 3 | STORE | – | 2004.02.05.10.15.45 | TEMPORARY STOCKER | 5 | NON-RECYCLING BOX | H001 | TRUE | ¥5000 |
| 22···001 | 3 | STORE | – | 2004.02.05.11.15.46 | TEMPORARY STOCKER | 4 | NON-RECYCLING BOX | H002 | TRUE | ¥2000 |
| 11···004 | 3 | STORE | – | 2004.02.05.11.15.47 | TEMPORARY STOCKER | 3 | ¥1000 BOX | 1004 | TRUE | ¥1000 |
| AA···002 | 3 | STORE | – | 2004.02.05.11.15.48 | TEMPORARY STOCKER | 2 | ¥10000 BOX | A002 | DUBIOUS | ¥10000 |
| AA···001 | 3 | STORE | – | 2004.02.05.10.15.49 | TEMPORARY STOCKER | 1 | ¥10000 BOX | A001 | TRUE | ¥10000 |
| 11···004 | 4 | DISPENSE | 456789 | 2004.02.05.12.18.21 | ¥1000 BOX | 1004 | CASH SLOT | 1 | INCLINATION ABNOMAL | ¥1000 |
| 11···003 | 4 | DISPENSE | 456789 | 2004.02.05.11.18.22 | ¥1000 BOX | 1003 | CASH SLOT | 2 | TRUE | ¥1000 |
| 11···002 | 4 | DISPENSE | 456789 | 2004.02.05.11.18.23 | ¥1000 BOX | 1002 | CASH SLOT | 3 | TRUE | ¥1000 |
| 11···001 | 4 | DISPENSE | 456789 | 2004.02.05.11.18.24 | ¥1000 BOX | 1001 | CASH SLOT | 4 | TRUE | ¥1000 |
| AA···001 | 4 | DISPENSE | 456789 | 2004.02.05.11.18.25 | ¥10000 BOX | A001 | CASH SLOT | 5 | TRUE | ¥10000 |

FIG. 8

80

| | CASH SLOT 6 | | TEMPORARY STOCKER 21 | | CASSETTE 22 | | NON-RECYCLING BOX 23 | | ¥1000 BOX 24 | | ¥10000 BOX 25 | |
|---|---|---|---|---|---|---|---|---|---|---|---|---|
| 1ST | | | | | | | 55···001 | ¥5000 | 11···001 | ¥1000 | AA···001 | ¥10000 |
| 2ND | | | | | | | 22···001 | ¥2000 | 11···002 | ¥1000 | AA···002 | |
| 3RD | | | | | | | | | 11···003 | ¥1000 | | |
| 4TH | | | | | | | | | 11···004 | ¥1000 | | |
| 5TH | | | | | | | | | | | | |
| 6TH | | | | | | | | | | | | |
| 7TH | | | | | | | | | | | | |
| 8TH | | | | | | | | | | | | |
| 9TH | | | | | | | | | | | | |
| | | | | | | | | | | | | |

FIG. 9

| ID NUMBER | POSITION IN SEQUENCE | TYPE OF TRANS-ACTION | ACCOUNT NUMBER | YEAR/MONTH/DAY/ HOUR/MINUTE/ SECOND | FEED FROM | | STORE INTO | | VALIDATION RESULT | |
|---|---|---|---|---|---|---|---|---|---|---|
| | | | | | | NO | | NO | CLASS | DENOMINATION |
| 11…001 | 1 | LOAD | – | 2004.02.05.08.20.30 | CASSETTE | C001 | ¥1000 BOX | 1001 | TRUE | ¥1000 |
| 11…001 | 4 | DISPENSE | 456789 | 2004.02.05.11.18.24 | ¥1000 BOX | 1001 | CASH SLOT | 4 | TRUE | ¥1000 |
| 11…002 | 1 | LOAD | – | 2004.02.05.08.20.31 | CASSETTE | C002 | ¥1000 BOX | 1002 | TRUE | ¥1000 |
| 11…002 | 4 | DISPENSE | 456789 | 2004.02.05.11.18.23 | ¥1000 BOX | 1002 | CASH SLOT | 3 | TRUE | ¥1000 |
| 11…003 | 1 | LOAD | – | 2004.02.05.08.20.32 | CASSETTE | C003 | ¥1000 BOX | 1003 | TRUE | ¥1000 |
| 11…003 | 4 | DISPENSE | 456789 | 2004.02.05.11.18.22 | ¥1000 BOX | 1003 | CASH SLOT | 2 | TRUE | ¥1000 |
| AA…001 | 1 | DEPOSIT | 123456 | 2004.02.05.10.15.36 | CASH SLOT | 1 | TEMPORARY STOCKER | 1 | TRUE | ¥10000 |
| AA…001 | 3 | STORE | – | 2004.02.05.10.15.49 | TEMPORARY STOCKER | 1 | ¥10000 BOX | A001 | TRUE | ¥10000 |
| AA…001 | 4 | DISPENSE | 456789 | 2004.02.05.11.18.25 | ¥10000 BOX | A001 | CASH SLOT | 5 | USABLE | ¥10000 |
| AA…002 | 1 | DEPOSIT | 123456 | 2004.02.05.10.15.37 | CASH SLOT | 2 | TEMPORARY STOCKER | 2 | TRUE | ¥10000 |
| AA…002 | 3 | STORE | – | 2004.02.05.10.15.48 | TEMPORARY STOCKER | 2 | ¥10000 BOX | A002 | DUBIOUS | ¥10000 |
| 11…004 | 1 | DEPOSIT | 123456 | 2004.02.05.10.15.38 | CASH SLOT | 3 | TEMPORARY STOCKER | 3 | TRUE | ¥1000 |
| 11…004 | 3 | STORE | – | 2004.02.05.11.15.47 | TEMPORARY STOCKER | 3 | ¥1000 BOX | 1004 | TRUE | ¥1000 |
| 11…004 | 4 | DISPENSE | 456789 | 2004.02.05.12.18.21 | ¥1000 BOX | 1004 | CASH SLOT | 1 | INCLINATION ABNOMAL | ¥1000 |
| 22…001 | 1 | DEPOSIT | 123456 | 2004.02.05.10.15.39 | CASH SLOT | 4 | TEMPORARY STOCKER | 4 | TRUE | ¥2000 |
| 22…001 | 3 | STORE | – | 2004.02.05.11.15.46 | TEMPORARY STOCKER | 4 | NON-RECYCLING BOX | H002 | TRUE | ¥2000 |
| 55…001 | 1 | DEPOSIT | 123456 | 2004.02.05.10.15.40 | CASH SLOT | 5 | TEMPORARY STOCKER | 5 | TRUE | ¥5000 |
| 55…001 | 3 | STORE | – | 2004.02.05.10.15.45 | TEMPORARY STOCKER | 5 | NON-RECYCLING BOX | H001 | TRUE | ¥5000 |

FIG. 10

| FINANCIAL INSTITUTION NO. | BRANCH NO. | APPARATUS TYPE | APPARATUS NO. | ACCOUNT TYPE | ACCOUNT NO. | PASSWORD | TRANSACTION TYPE | SUM |
|---|---|---|---|---|---|---|---|---|
| 0005 | 156 | 13 | 06 | 04 | 123456 | 0123 | DEPOSIT | 28,000 |

PAPER MONEY HANDLING MACHINE

The present application claims priority from Japanese Application JP 2004-255327 filed on Sep. 2, 2004, the content of which is hereby incorporated by reference into this application.

BACKGROUND OF THE INVENTION

The present invention relates to a paper money handling apparatus, and more particularly to management of securities such as bills, including validation of true securities against false ones and protection from illicit use by applying IC chips. It relates to, for instance, a managing method and system for bills in which wireless IC chips are embedded to be handled by automatic teller machines (ATMs).

It is proposed to embed IC chips in bills, gift certificates and securities such as share certificates, so that stolen securities can be prevented from subsequent illicit use or effectively managing the reuse of securities, if recovered, by their legitimate managers by managing information, unique to each such security, stored in the IC chips.

For instance, Patent Reference 1 (Japanese Published Unexamined Patent Application No. 2001-260580) discloses securities in which non-contact wireless IC chips (e.g. RFID) are embedded and information in the IC chips is made rewritable together with a method and a system of preventing illicit use of such securities.

Patent Reference 2 (Japanese Published Unexamined Patent Application No. 2003-178185) discloses a securities processing system which registers in advance in a database (DB) ID information (and securities information) regarding securities in which IC chips storing ID information are embedded and determines validity or invalidity of securities at the time of issue by referencing this ID information registered in the DB.

Patent Reference 3 (Japanese Published Unexamined Patent Application No. 2004-164156) discloses a cash processing machine enabled to discriminate individual bills even if some of them are sticking to each other by providing each sheet with a built-in wireless IC and equipping the bill discriminator arranged on the bill conveying path with an antenna communicating with the wireless ICs.

No such bill provided with an IC chip as the ones disclosed in the references cited above is in circulation as yet. Any ATM in current use discerns the trueness or falseness of paper money by detecting the dimensions and optical or magnetic characteristics of each sheet, and the management of bills seems to be relying on information on the results of such true/false tests and reference numbers of bills.

To focus on the serial numbers of Bank of Japan notes, for instance, such a number is printed only on the front face of each bill, and its position differs from one denomination to another. Since bills are usually folded and kept in their bearer's wallet, they are likely to be creased. In order for an ATM to optically read surface information on a creased bill, it is necessary to smoothen the bill and perform sophisticated convey control involving accurate keeping of the bill's positional relationship with an optical sensor reading it.

Moreover, as the background of the serial number includes a clearly printed portrait and pattern, reading the serial number of alphabetic letters and numerals isolated from the rest of the read image of the bill requires a color sensor of a high reading resolution, sophisticated image processing techniques and character reading techniques.

Incidentally, more than 10 billion Bank of Japan notes are in circulation, and the effective life of each note is estimated at one to two years. Moreover, since the serial number consists of only nine letters and numerals, the same serial number is shared by more than one bill, and therefore the number is printed in different colors for further discrimination. On account of this circumstance, it is very difficult to read the serial number and to discriminate and manage bills by the serial number, and accordingly this technology does not seem to be available for practical use as yet.

In the management of bills by an ATM for instance, it is attempted to assign a virtual serial number to each transaction of a customer, assign another sequence of virtual serial numbers to bills in the order of conveying them from the cash slot to the conveying path, store the denominations and true/false test results of bills obtained from the bill discriminator into a memory with these virtual serial numbers as keys, and store good bills into a temporary stocker or reject false or otherwise unacceptable bills back to the cash slot.

However, these serial numbers assigned to bills are virtual numbers only for temporary use while the bills are conveyed within the ATM, and the bank attendant cannot visually recognize such serial numbers of bills having passed the ATM in his or her charge. Moreover, if bills become jammed during their conveyance and the attendant extracts the jammed bills, this will constitute a factor of uncertainty, which ruins the precondition of assigning the virtual serial numbers. For this reason, it is difficult to uniquely identify each individual bank note in the ATM.

SUMMARY OF THE INVENTION

An object of the present invention is to provide a paper money handling apparatus, method and system which can accurately manage the location of paper money sheets and facilitate their tracing by using wireless IC chips.

According to the invention, there is provided a paper money handling apparatus for handling paper money sheets each having an IC chip which holds unique discriminative information, the paper money handling apparatus including a conveying path for conveying the paper money sheets; a surface information reader for reading surface information on the paper money sheets conveyed over the conveying path and performing true/false determination of the paper money sheets; a wireless IC reader for reading discriminative information held by the IC chips of the conveyed paper money sheets; a memory unit for storing information on a result of determination by the surface information reader and discriminative information obtained by the IC reader matched with each other; and information searching means for searching for information stored in the memory unit.

For instance, the memory unit may be a hard disk for storing a paper money management table formed by matching the information on the result of determination and discriminative information with each other; and the information searching means may include an attendant-operable unit to be operated by an attendant handling the paper money handling apparatus and a controller for searching the table in the hard disk by controlling operational instructions from the attendant-operable unit.

A bill handling apparatus as embodied in a preferred mode of implementing the invention handles bills each having an IC chip which holds unique discriminative information, and includes a manipulating unit for selecting the type of transaction to be done by a customer; a controller for recognizing the type of the transaction selected with the manipulating unit; a conveying path for conveying the bills; a surface information reader for reading surface information on the bills conveyed over the conveying path and performing true/false determination of the bills; a wireless IC reader for reading discriminative information held by the IC chips of the conveyed bills; and a memory unit for storing information on a result of determination by the surface information reader, discriminative information obtained by the IC reader and information on the type of transaction by a customer recognized by the controller, all matched with one another.

For instance, the memory unit composes, by using the discriminative information obtained from the IC chips as keys, information on a result of discrimination of bills and information on the type of transaction by the customer into a bill management table and stores the table. In another example, the memory unit further stores a second table in which rearranged information is stored, with reference to the discriminative information from information registered in the bill management table. The bill handling apparatus may further have an attendant-operable unit to be operated by an attendant; and the controller may process searching of the bill management table or the second table for information in accordance with an instruction from the attendant-operable unit.

In a bill management system according to the invention for collecting from a bill handling apparatus, which handles bills each having an IC chip holding unique discriminative information, information on the bills and managing the information, the bill handling apparatus includes a manipulating unit for selecting the type of transaction to be done by a customer; a controller for recognizing the type of the transaction selected with the manipulating unit; a surface information reader for reading surface information on the bills handled and performing true/false determination of the bills; and a wireless IC reader for reading discriminative information held by the IC chips of the conveyed bills; the bill handling apparatus further including a memory device for storing information on a result of determination by the surface information reader, collected from the bill handling apparatus, discriminative information obtained by the IC reader and information on the type of transaction by the customer recognized by the controller, all matched with one another; and an information processing unit for search information stored in the memory device by using the discriminative information as a key.

A bill management method according to the invention for use in a bill handling apparatus, which handles bills each having an IC chip holding unique discriminative information, includes a step of recognizing the type of transaction to be done by each customer using the bill handling apparatus; a step of conveying bills over a conveying path for transactions with customers; a surface information reading step of reading with a bill discriminator, installed on the conveying path, surface information on the conveyed bills and performing true/false determination of the bills; an IC chip reading step of reading with a wireless IC reader discriminative information held by the IC chips of the bills conveyed over the conveying path; and a step of storing into a memory unit information on a result of determination of the read surface information, the discriminative information obtained by the IC reader and information on the recognized type of transaction by the customer, all matched with one another.

In a preferable case, every time a bill passes the bill discriminator on the conveying path, the surface information and discriminative information of the bill may be acquired and stored into the memory unit to be distinguishable from previously acquired such information. In another preferable case, an account number acquired from a card used by the customer and information regarding the time when the transaction was done may be stored, being matched with the discriminative information. In still another preferable case, the method may further include an information searching step of searching for information stored in the memory unit by using the discriminative information as a key.

It is also preferable for the method to further include a step of adding machine-specific information on the bill handling apparatus to information stored in the memory unit and transmitting the resultant augmented information to a host computer to which the bill handling apparatus is connected.

BRIEF DESCRIPTION OF THE DRAWINGS

A preferred embodiment of the present invention will now be described in conjunction with the accompanying drawings, in which:

FIG. 7 shows a bill management table 70 in which the state of paper money management is to be registered in the embodiment;

FIG. 8 shows a bill management table 80 whose contents are classified by the storing position in the embodiment;

FIG. 9 shows a registration-sequenced bill information table 90 in the embodiment in which the sequence is in the order of registration; and FIG. 10 shows an example of telegraph between an ATM and a host computer in the embodiment.

DESCRIPTION OF THE PREFERRED EMBODIMENT

A preferred embodiment of the present invention will be described in detail below with reference to the accompanying drawings.

Whereas paper money sheets in the context of the invention include bills, promissory notes, checks, share certificates, bonds and gift certificates, the following description will refer, by way of example, to bills handled by financial institutions equipped with ATMs. An ATM is usually equipped with a bill recycling mechanism (BRM), which accepts bills deposited into the ATM and uses them to respond to withdrawing transactions by customers.

This embodiment uses bills each of which has, embedded in one of its corners, a wireless IC chip having unique identifying information (ID number). The number of digits of information recorded on the IC chip is, for instance, 128. The information to identify a bill may include unique items such as its issuing country, denomination, version number (new or old), the production number at the printing bureau, and the history of changes in production. It is not necessary to use all the 128 digits, some of which may remain unused. The ID number of the IC chip is read by a wireless IC reader disposed somewhere on the conveying path, for instance the bill discriminator of the ATM.

Figure 1:
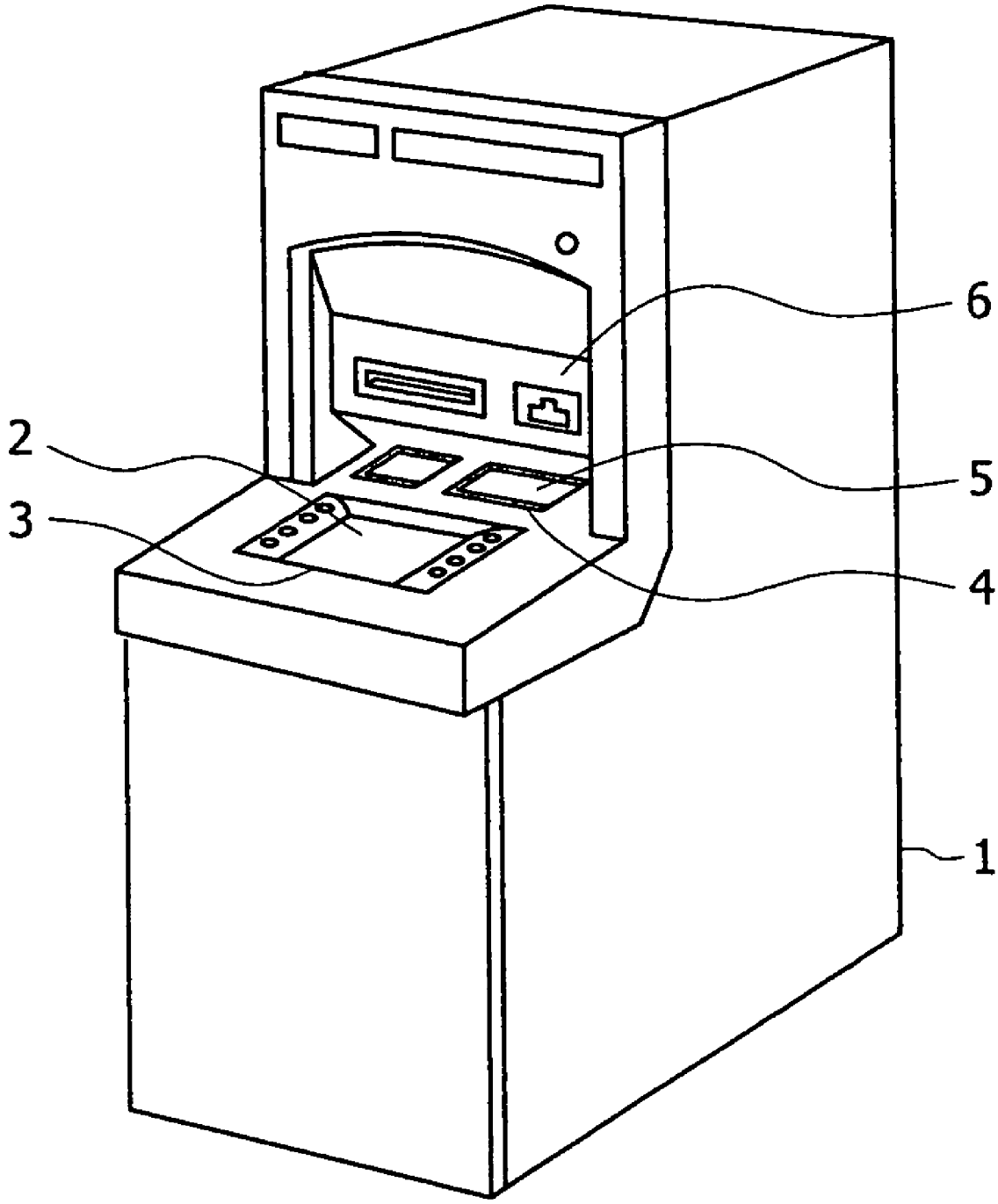
FIG. 1 shows an external view of a commonly known ATM.

FIG. 1 shows an external view of the ATM. An ATM 1 has a display unit 2 for displaying guidance to users, a manipulating unit 3 for receiving manipulation inputs by way of buttons or a touch panel in accordance with a guidance display on the display unit 2, and a cash slot 4 for accepting bill deposits and delivering payable bills. In a cash transaction, a customer-owned cash card is inserted into a card/slip processing mechanism 6, wherein card processing and transaction processing take place. A shutter 5 is arranged above the cash slot 4. The customer puts bills within the shutter 5 when depositing money, or takes out bills discharged inside the shutter 5 when withdrawing money.

Figure 2:
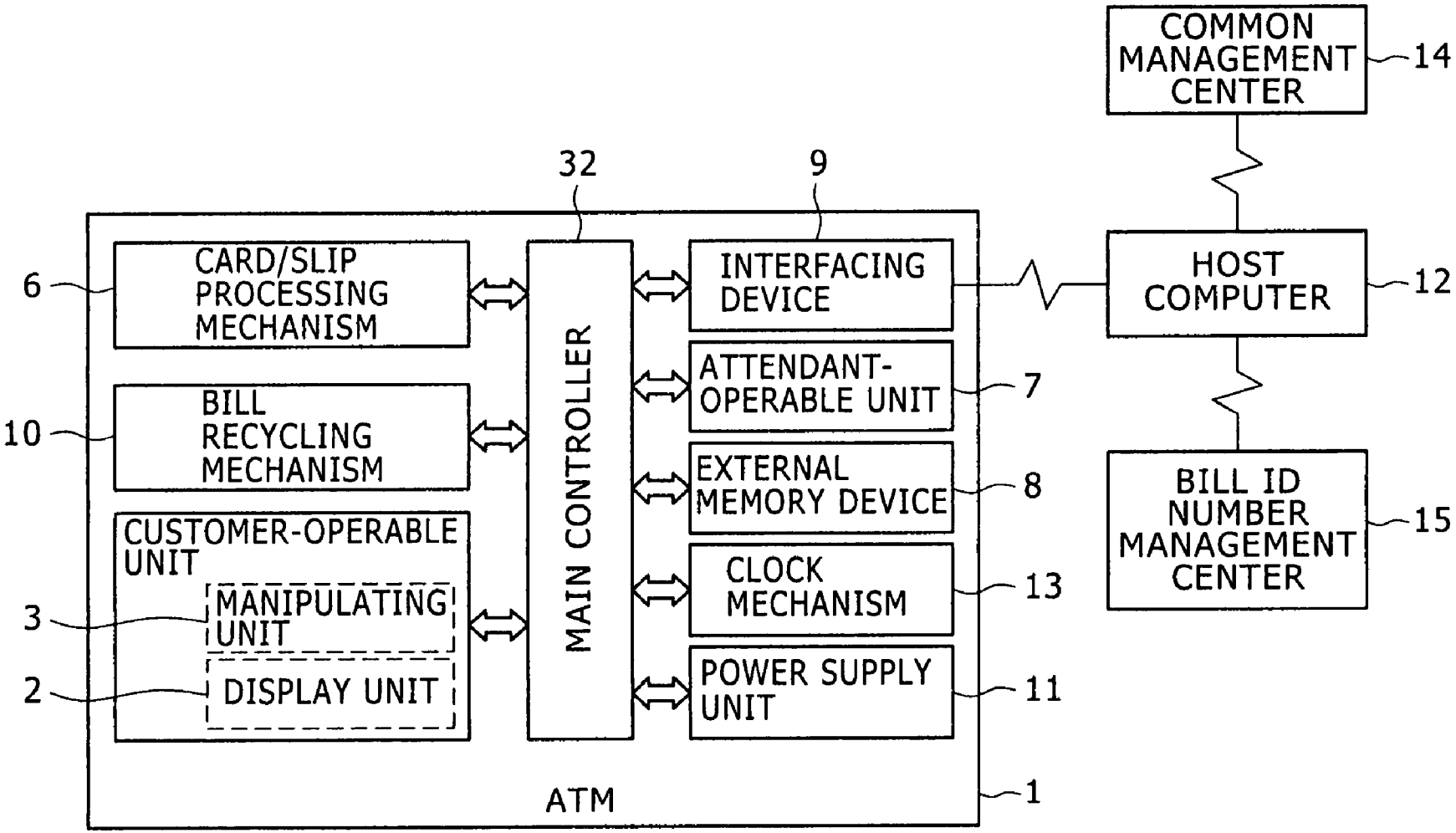
FIG. 2 is a control block diagram of an ATM in a preferred embodiment of the invention.

FIG. 2 is a control block diagram of the ATM. In the ATM 1, a customer-operable unit having the aforementioned display unit 2 and manipulating unit 3, the card/slip processing mechanism 6 and a paper money recycling mechanism 10 are connected to a main controller 32, and necessary operations are performed under the control of the main controller 32. The main controller 32 is also connected to an attendant-operable unit 7, an external memory device (HDD) 8, an interfacing device 9 and a clock mechanism 13, and transfers necessary data to and from these units. Though not shown, the main controller 32 has a processor and a memory to process and store various data regarding cash transactions.

As will be described in more detail afterwards, a bill management table 70 shown in FIG. 7, a bill management table 80 whose contents are classified by the storing position shown in FIG. 8, and a registration-sequenced bill information table 90 shown in FIG. 9 are stored in the external memory device 8.

In the bill management table 70, management information regarding bills is registered with the ID numbers of bills being used as the keys. In the storing position-based bill management table 80, the ID numbers of bills stored in each bill storing box are registered. Items of bill information registered in the bill management table 70 are acquired, rearranged in the order of ID numbers and registered in the registration-sequenced bill information table 90 in that rearranged order.

The clock mechanism 13, which is a calendar clock keeping time by the year, month, day, hour, minute and second, informs the main controller 32 of the time of each transaction of depositing, withdrawing or the like by a customer. A power supply unit 11 supplies electric power to the main controller 32, the aforementioned mechanisms and constituent parts. The interfacing device 9 is connected to and exchanges necessary data with a host computer 12 installed at the computation center of the financial institution. The format of the telegraphs exchanged between the ATM 1 and the host computer 12 includes such items of information as the financial institution number, branch number, apparatus type, apparatus number, account type, account number, password, transaction type and sum as shown in FIG. 10.

The host computer 12 is equipped with a large-capacity memory device for managing information on customers' accounts. The host computer 12 is also connected to a management center 14 jointly managed by a plurality of financial institutions and a bill ID number management center 15 established at the Bank of Japan. At both centers 14 and 15, information on bills collected from the host computers 2 of financial institutions is managed with the ID numbers of bills being used as the keys.

Now, the configuration of the bill management table 70 will be described with reference to FIG. 7. For the IC chip of each bill, the ID number 71 has a position in sequence 72, a transaction type 73, an account number 74, a time 75, a bill feed source 76, a bill store destination 77 and a validation result 78 are registered in the bill management table 70. The position in sequence 72 means the position in the sequence of bill handling; position 1, for instance, is a mode in which the attendant of the financial institution or somebody else inserts a cassette 22 into the ATM and loads a storing box with bills in the cassette. Since no transaction by any customer is involved in this mode, no account number is registered. It concerns a state of management in which true ¥1000 real notes have been transferred from the cassette in the bill feed source 76 to a ¥1000 box in the bill store destination 77.

In position 2, a customer whose account number is 123456 has deposited a total of six bills, of which five are in a temporary stocker and the remaining one (having an ID number of "R0-001") has been rejected to the cash slot. In position 3, the five bills held in the temporary stocker are stored in a non-recycling box, the ¥1000 box and a ¥10000 box. In position 4, another customer whose account number is 456789 has withdrawn bills in a sum of ¥14,000. Time information on the state of each bill is also registered.

Next, referring to FIG. 8, the storing position-based bill management table 80 successively memorizes and holds the ID numbers of bills, classified by the location in which they are stored, namely a non-recycling box 23, ¥1000 box 24 or a ¥10000 box 25. Since this storing position-based bill management table 80 dynamically manages bills, keeping the increase or decrease of bills on a real time basis, the ID numbers of bills delivered out and discharged from the ¥1000 box 24 and the ¥10000 box 25, both of which are recycling boxes, are erased.

As shown in FIG. 9, the registration-sequenced bill information table 90 is prepared by rearranging under the control of the main controller 32 the contents of the bill management table 70 shown in FIG. 7 into the order of ID numbers of bills with the ID number being used as the keys. It is preferable for the updating of the registration-sequenced bill information table 90 to be processed with reference to the bill management table 70 on a real time basis every time one transaction has been completed.

Figure 3:
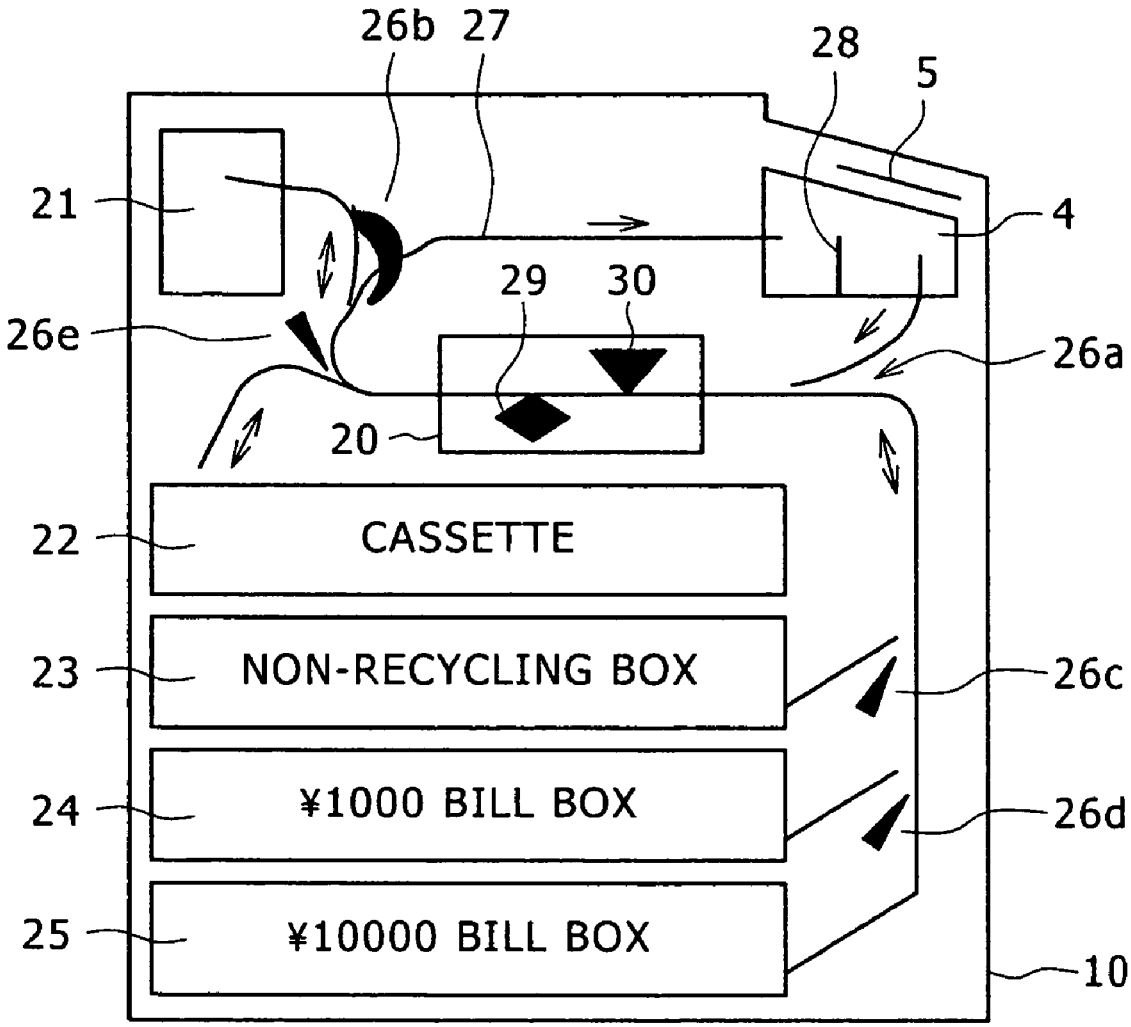
FIG. 3 is a profile of a paper money recycling mechanism 10 in the preferred embodiment of the invention.

FIG. 3 shows the configuration of the bill recycling mechanism (BRM) 10. The BRM 10 is a mechanism for handling bills within the ATM 1; in the illustration, the right hand side is toward the user. An intermediate plate 28 is disposed within the cash slot 4 to partition the slot into an in-portion and an out-portion.

A discriminator 20 for identifying the denominations of ¥1000, ¥10000 and other bills and performing true/false determination of bills; a temporary stocker 21 for temporarily holding bills having passed the discriminator 20 until the customer confirms the sum to be deposited; a non-recycling box 23 for storing ¥5000 bills, which are not used for payment to customers, and too heavily damaged bills for recycling; the ¥1000 box 24, the ¥10000 box 25 for storing ¥10000 bills and other units are linked to the conveying path 27 which is linked to the cash slot 4. Incidentally, bills are pinched between belts or rollers when they are conveyed over the conveying path 27, which is equipped, where required, with gates **26*a* through 26*e*** for switching the direction of conveying the bills.

The ¥1000 box 24 and the ¥10000 box 25 are collectively referred to as the recycling boxes. There also is mounted a cassette 22 for loading the recycling boxes with bills and holding the bills picked up by the attendant from the recycling boxes to be carried away.

The discriminator 20 is provided with a surface information reader 29 for optically or magnetically reading surface information, such as patterns and characters, on the surface of each bill to identify the denomination and perform true/false determination of bills and an IC reader 30 for reading ID information of the IC chip embedded in each bill. The IC reader 30 includes an antenna to be used for the transmission and reception mainly of electromagnetic waves and a signal processor for processing signals transmitted to or received from IC chips.

Figure 4:
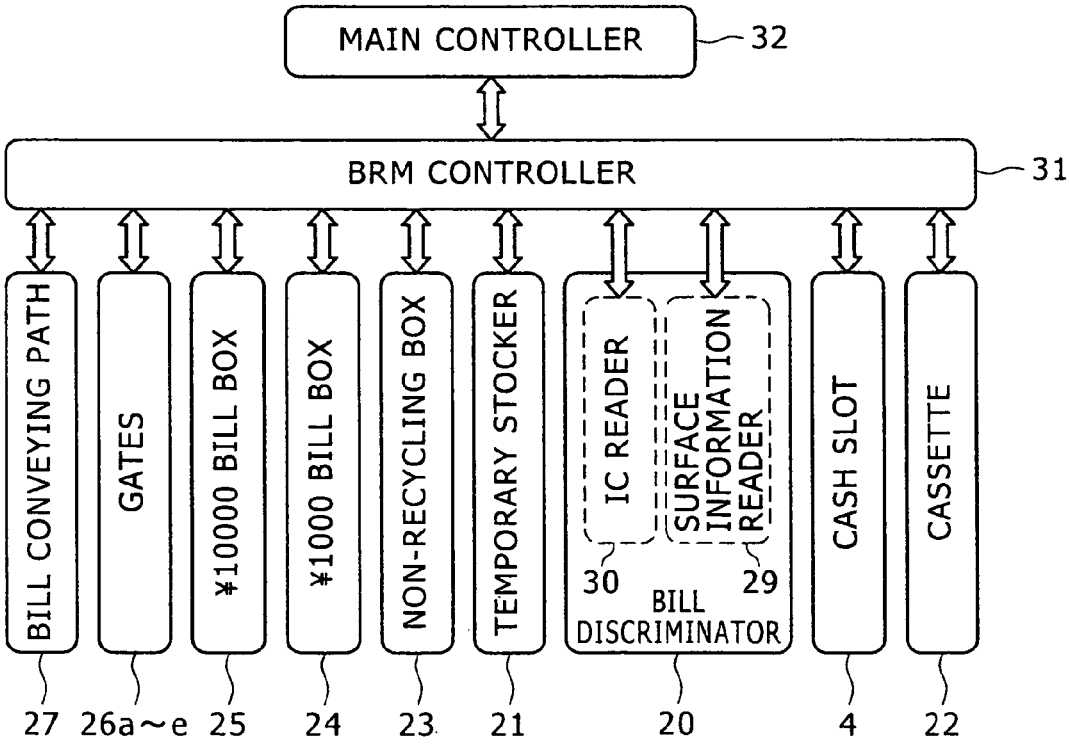
FIG. 4 is a functional block diagram of the paper money recycling mechanism 10 in the embodiment.

FIG. 4 is a functional block diagram of the BRM 10. A BRM controller 31 is connected to the main controller 32, controls the BRM 10 in accordance with instructions from the main controller 32 and the detected state of the BRM 10, and transmits as required information on the BRM 10 to the main controller 32. The same elements as their counterparts in FIGS. 2 and 3 are denoted by respectively the same reference signs, and their description will not be duplicated.

Figure 5:
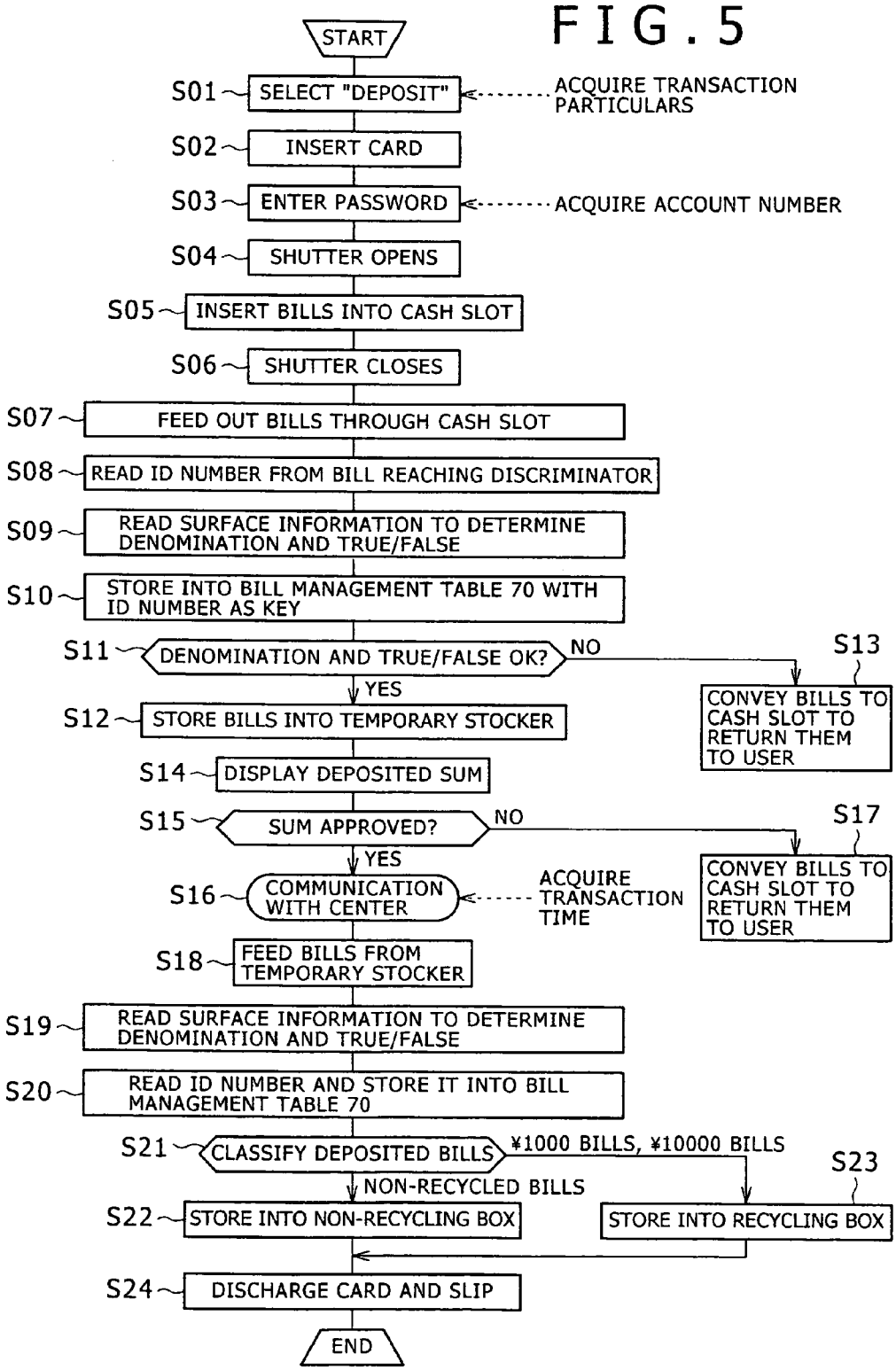
FIG. 5 is a flowchart of paper money handling in a depositing transaction in the embodiment.

Next, the operations to handle bills that are deposited will be described with reference to the flowchart in FIG. 5.

When the ATM 1 detects the approach of a customer, a transaction selecting screen is displayed on the display unit 2. Looking at the transaction selecting screen, the customer manipulates the manipulating unit 3 to select "Deposit" and enters it (S01). Then, the main controller 32 acquires the type of transaction selected by the customer, and stores it into a memory (not shown). Next the customer inserts a cash card into the medium slit of the card/slip processing mechanism 6 (S02). Then, the card processing mechanism reads information stored in the card, namely information items including the customer's account number, and similarly stores that information into the memory of the main controller 32.

When the customer enters a password into the manipulating unit 3 (S03), the shutter 5 of the cash slot 4 opens (S04). When a bill or bills are put into the in-portion (toward the customer) of the cash slot 4 (S05), bills are fed out to the conveying path 27 after the shutter 5 is closed (S06) and conveyed via the gate 26*a* to the discriminator 20 (S07).

Having arrived at the discriminator 20, the bills first undergo reading of the ID numbers of their respective IC chips by the IC reader 30 (S08). Then, the surface information reader 29 reads such items of surface information as the patterns and characters printed on and the degree of magnetization and thickness of the bills to identify the denomination and perform true/false determination of the bills (S09).

Then the BRM controller 31 successively transmits to the main controller 32 the items of ID information read by the IC reader 30. Since the BRM controller 31 can sense handling information on the bills, namely the situational factors of the bill bearing a given ID number, such as its feed source, position in the sequence of bills fed from that source, destination and position in the sequence of bills stored into that destination, the main controller 32 successively collects such bill management information.

The main controller 32 then puts together information on the state of the bills, including the type of transaction selected by the customer and the customer's account number, with the ID numbers of bills collected from the BRM controller 31 being used as the keys, and registers it as new management information in the bill management table 70 (FIG. 7) stored in the external memory device 8 (S10).

If a given bill is found false as a result of determination by the bill discriminator 20 according to surface information (No at S11), that bill is conveyed to the out-portion of the cash slot 4 via the gate 26*b* and returned to the customer (S13). Or any bill found true as a result of determination according to surface information (Yes at S11) is conveyed to and stored into the temporary stocker 21 (S12).

When every bill entered into the cash slot 4 has gone through the validation procedure in this way, the total sum of the bills found true is displayed on the display unit 2, and a confirmation input by the customer through the manipulating unit 3 is awaited (S14). The contents of the bill management table 70 then are a group of data in the state of position 2 in FIG. 7.

Now, if in the action to check the deposited sum the customer does not approve of the sum (No at S15), all the bills held in the temporary stocker 21 will be conveyed to the out-portion of the cash slot 4 and returned to the customer (S17). Or if the customer inputs confirmation (Yes at S16), the main controller 32 will transmit transaction information to the host computer 12 via the interfacing device 9 to update the balance of the customer's pertinent account (S16). On this occasion, it acquires the customer's transaction time.

Next, bills held in the temporary stocker 21 are fed out to the conveying path 27 via the gate 26*b*, and conveyed to the discriminator 20 (S18). Each bill passing the discriminator 20 first undergoes reading of its surface information by the surface information reader 29, and its denomination and validity are determined (S19). Then the ID number of its IC chip is read by the IC reader 30, and this ID number, together with information on the result of discrimination of the bill, is transferred to the main controller 32 to be stored into the bill management table 70 in the external memory device 8 (S20).

Bills are classified by the denomination and the result of true/false determination (S21), and stored into corresponding storing boxes. Thus, ¥1000 bills are stored into the 1000 box 24 and ¥10000 bills, into the ¥10000 box 25 (S23). Since ¥2000 and ¥5000 bills are not used for payment to customers, they are collected into the non-recycling box 23 (S22).

The contents of the bill management table at the time of this storing are in the state of position 3 in the management table shown in FIG. 7. For instance, the ¥10000 bill of ID No. AA--002, though it is found dubious in the discrimination procedure, is found true in the second block of deposition, with its ID number being read too, and therefore deemed true to be stored into the ¥10000 box 25. Incidentally, there is no need to limit discrimination to this procedure, but the setting can be altered for more strict management of the state of bills to collect any bill once found dubious into the non-recycling box 23.

Further, since the main controller 32 is aware of the state of each bill when it is finally stored into a storing box, the contents of the storing position-based bill management table 80 are also updated on this occasion. Upon completion of data processing for a transaction with any customer, finally the customer's cash card and a transaction slip is discharged from the medium slit of the card/slip processing mechanism 6 (S24), and the customer receives them to end the sequence of transaction.

Figure 6:
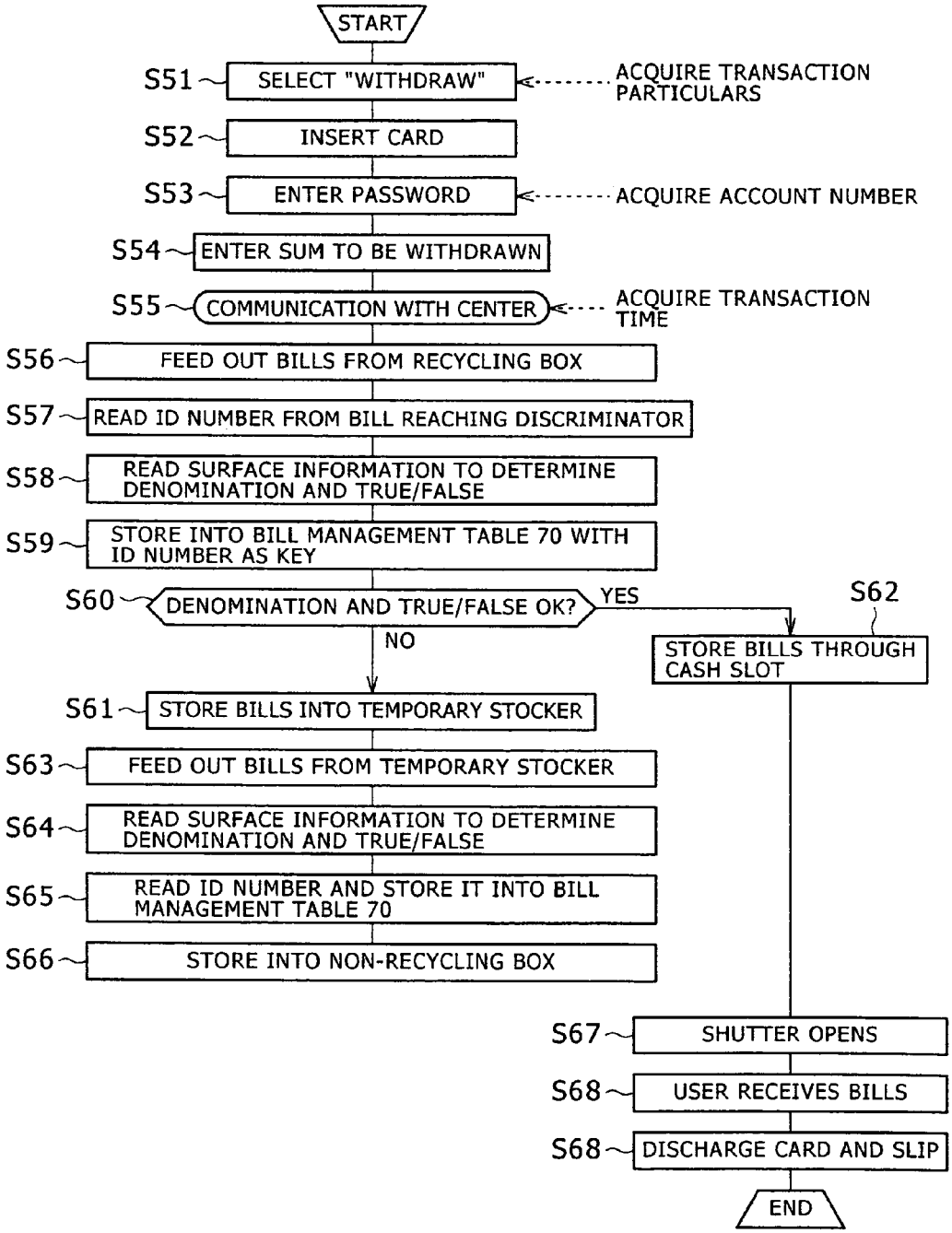
FIG. 6 is a flowchart of paper money handling in a withdrawing transaction in the embodiment.

FIG. 6 is a flowchart of paper money handling in a withdrawing transaction by another customer. The customer manipulates the manipulating unit 3 to select "Withdraw" (S51) and then inserts his or her cash card (S52). Next, the customer enters a password into the manipulating unit 3 (S53) and then inputs the sum to be withdrawn (S54). The transaction information acquired in this way is transmitted from the ATM 1 to the host computer 12, and communication with the center thus takes place between the ATM 1 and the host computer 12 (S55).

The host computer 12 confirms the identity of the customer by checking the entered password, updates the account balance, and transmits a payment permit to the ATM 1. When the ATM 1 receives the payment permit, the BRM 10 successively feeds out bills in the amount of requested withdrawal from recycling boxes to the conveying path 27 (S56).

Each bill passing the discriminator 20 first undergoes reading of the ID number of its IC chip by the IC reader 30 (S57). Then, the surface information reader 29 reads such items of surface information as the patterns and characters printed on and the degree of magnetization and thickness of the bills to identify the denomination and perform true/false determination of the bills (S58). The bill information acquired in this way is stored under the control of the main controller 32 into the bill management table 70 with the ID numbers of bills being used as the keys (S59).

Any bill found false as a result of determination (No at S60) is stored into the temporary stocker 21 via the gate 26*b* (S61). Or any bill found true as a result of discrimination (Yes at S60) is conveyed to the cash slot 4 and held there (S62).

When the bills discharged reach the sum to be withdrawn, the bills in the temporary stocker 21 are fed out onto the conveying path 27 via the gate 26*b* and conveyed to the discriminator 20 (S63). Each bill passing the discriminator 20 undergoes reading of surface information by the surface information reader 29 to be determined whether it is true or false (S64). Then the IC reader 30 reads the ID number of its IC chip, and these items of bill information are stored into the bill management table 70 with the ID number as the key (S65), and the bills are stored into the non-recycling box 23 (S66).

The contents of the bill management table 70 at this point of time are in the state of position 4 in the table shown in FIG. 7. Out of the bills in the state of position 4, the ¥1000 bill of ID number 11--004, though found "Inclination abnormal" because of its poor fed-out state, is found true also in storing for deposition, with its ID number being accurately read too, and therefore deemed to be a true ¥1000 bill to be conveyed to the out-portion of the cash slot 4. Incidentally, there is no need to limit discrimination to this procedure, but the setting can be altered for more strict management of the state of bills to collect any bill found abnormal in conveyance into the non-recycling box 23.

Further, even if the ID number of any bill fails to be read, it is also possible to infer the ID number of this bill from information on the bills stored immediately before and after this one by referencing the bill management table 70 of FIG. 7, and restore its ID number. For instance, since bills stored into a recycling box are fed out in an order reverse to that of their storing, even if the ID number of any one bill fails to be read when it is to be paid out or this bill fails to be discriminated accurately, it is possible to restore the bill information which has failed to be read accurately by referencing the bill management table 70 and acquiring information on the bill at the time it was accepted and stored.

When all the bills in the temporary stocker 21 have been stored into the non-recycling box 23, the shutter 5 of the cash slot 4 is opened (S67), enabling the customer to receive the bills to be withdrawn (S68). After that, his or her cash card and a slip are discharged from the ATM 1 (S69), which the customer receives to end the sequence of transaction.

To add, as the contents of the bill management table 70 are referenced and those of the registration-sequenced bill information table 90 are updated every time the processing of one transaction is ended, the whereabouts of any bill can be found out by referencing this table 90. For instance, the source of a bill bearing a certain ID number, i.e. the account number of the customer who deposited it, and its destination, the account number of the customer who withdrew it can be known. This is also true of any bill stored in a non-recycling box. The attendant-operable unit 7 of the ATM 1 is also equipped with a display unit and a manipulating unit for inputting to be used by the attendant, similar to those of the customer-operable unit. Therefore, it is possible to uniquely identify any bill to be identified by searching the bill management table 70, the registration-sequenced bill information table 90 or the like with the ID number of the bill being used as the key at an instruction from the attendant-operable unit 7. Thus, the attendant-operable unit 7 and the main controller 32 serve here as information searching means.

Also, it is possible to keep trace of any illicit act by the attendant of the financial institution by utilizing the registration-sequenced bill information table 90. If, for instance, the attendant is to manipulate the attendant-operable unit 7, he or she is required to enter a password for the attendant's exclusive use. This exclusive password and the time of manipulation by the attendant are registered in the external memory device 8 as logs. By collating this log information with the contents of the registration-sequenced bill information table 90, any bill inadvertently picked up by the attendant from anywhere in the ATM can also be kept trace of.

It is also possible to extract, under the control of the main controller 32, the financial institution number, branch number, machine type and machine number out of information constituting the telegraph of communication shown in FIG. 10, add information matching each ID number in the registration-sequenced bill information table 90 with these items of information as header information, and transmit them from the ATM 1 to the host computer 12 to enable these items of bill information to be collectively managed in the database DB with which the host computer 12 of the financial institution is provided.

Also, by transmitting similar items of information to the management center 14 jointly used by different financial institutions and storing them collectively in its database, bills in their circulation process can be kept trace of among these financial institutions.

It is further possible to establish a management center 15 equipped with a database for managing paper money ID numbers at the Bank of Japan, the issuing source of bills, and to collect similar information to what was described above at this center 15. Such a system would make possible true/false discrimination and keeping trace of bills by making inquiries by the ID number and moreover to establish a system of bill tracing and security on a nationwide scale.

As hitherto described, in this embodiment of the invention, even if bills determined by the discriminator at the time of loading the cassette or when the bills are deposited and stored into a recycling box are later found impossible, when they are to be paid out, to be identified in denomination or determined to be true or false on account of failure to normally acquire discriminative information based on the bills' surface information, affected by such conveyance factors as abnormal inclination or spacing, it is still possible, if the ID numbers of their IC chips can be read, to identify their denomination and number by reading discriminative information acquired at the time of their depositing or loading stored in the bill management table 70 or the table 90. As a result, bills which would have been collected into the non-recycling box on account of impossibility to identify their denominations or to determine them to be true or false by the conventional technique can still be used for payment if this embodiment allows their normal discrimination according to the ID numbers. Therefore, the number of bills unsuitable for recycling can be significantly reduced, with a corresponding improvement in the efficiency of fund utilization.

Also, as the results of bill validation are cumulatively stored with the ID number of the IC chips of bills being used as the key every time a bill moves in the ATM, the accuracy (reliability) of bill validation is enhanced. Even if the results of identifying the denomination at different times differ, the bill concerned will be collected into the non-recycling box, and accordingly wrong discrimination can be prevented.

Furthermore, even if the attendant illicitly picks up any bill from the ATM, the customer leaves behind withdrawn bills, or any bill remains in the cash slot undetected, any such a bill in the ATM can be located or its owner identified and confirmed by searching the tables 70, 80 and 90 by using the ID number of the bill used as the key, resulting in enhanced security.

Although the present invention has been described so far with reference to a preferred embodiment thereof, the invention is not limited to this embodiment, but can be modified in many different ways.

For instance, the tables 70, 80 and 90 in this embodiment are described to be stored in the external memory device 8 within the ATM 1. However, a modification is conceivable in which these tables are architected in the database (DB) of a server installed in each branch of the financial institution. Since bill-related information is transmitted from a plurality of ATMs installed in each branch to the server, the server has to register the machine number of the ATM which has handled each bill correspondingly to the ID number of the bill in addition to the contents of the tables 70, 80 and 90. Searching of bill-related data stored in the DB of the server is accomplished by the attendant using a personal computer (PC). In this sense, the PC serves as information searching means. Incidentally, bill-related are transmitted to the host computer 14 from this server.

The definitions of terms or the names of elements in this embodiment constitute a mere example, but not the only possible definitions or names. This is true of the compositions and names of the tables, which could be otherwise than in this embodiment. These tables may as well be called databases and configured as such.

According to the invention, paper money sheets in the apparatus can be accurately located and their movements readily kept trace of on the basis of distinguishing information held by IC chips. In an apparatus handling bills for instance, by storing in memory means discriminative information based on surface information on bills and discriminative information held by IC chips matched with each other, even where discriminative information based on bill surface information cannot be normally acquired, the bills can be smoothly and effectively handled by utilizing the discriminative information held by IC chips. Furthermore, even if any paper money sheet is illicitly picked up from the paper money handling apparatus, the bill searched for can be detected by searching the contents of the memory means. Any non-real paper money sheet or the like can also be kept trace of by using discriminative information held by IC chips as the key.

What is claimed is:

1. A bill handling apparatus for handling bills each having an IC chip which holds unique discriminative information, the bill handling apparatus comprising:

a manipulating unit for selecting the type of transaction to be done by a customer;

a controller for recognizing the type of the transaction selected with the manipulating unit;

a conveying path for conveying the bills;

a bill discriminator for reading surface information on the bills conveyed over the conveying path and performing true/false determination of the bills;

a wireless IC reader for reading discriminative information held by the IC chips of the bills being conveyed on the conveying path; and a memory unit for storing a first bill management table and a second management table, wherein said first bill management table registers the discriminative information obtained from the IC chips through said the wireless IC reader, information on a result of discrimination of bills through said bill discriminator, and transaction information including a type of transaction by the customer, the discriminative information, and the information on the result of discriminative information, and the information on the result of discrimination being obtained ever time the bill passes through said the wireless IC reader and said bill discriminator, wherein the same information can be registered a plurality of times in said first bill management table, wherein said second management table registers said discriminative information, the result information, and the transaction information from said first bill management table of which the information is rearranged in sequence of the discriminative information without duplication of the same discriminative information, and wherein said discriminative information, the result information, and the transaction information are searchable by a processing means for tracing the bill.

2. The bill handling apparatus according to claim 1, wherein:

the bill handling apparatus further comprises an attendant-operable unit to be operated by an attendant; and the controller processes searching of the bill management table or the second management table for information in accordance with an instruction from the attendant-operable unit.

3. The bill handling apparatus according to claim 1, wherein:

said controller judges whether the bill should be dispensed or not according to said discriminative information registered in said first bill management table and/or said second management table when the bill during dispensing has not been determined on true/false by said bill discriminator.

4. A bill management system for collecting from a bill handling apparatus, which handles bills each having an IC chip holding unique discriminative information, information on the bills and managing the information, comprising:

the bill handling apparatus including a manipulating unit for selecting the type of transaction to be done by a customer; a controller for recognizing the type of the transaction selected with the manipulating unit; a bill discriminator reader for reading surface information on the bills handled and performing true/false determination of the bills; and a wireless IC reader for reading discriminative information held by the IC chips of the conveyed bills;

a memory unit for storing a first bill management table and a second management table; and an information processing unit for search information stored in the memory device by using the discriminative information as a key, wherein said first bill management table registers the discriminative information obtained from the IC chips through said the wireless IC reader, information on a result of discrimination ob bills through said bill discriminator, and transaction information including a type of transaction by the customer, the discriminative information and the information on the result of discrimination being obtained every time the bill passes through said the wireless IC reader and said bill discriminator, wherein the same information can be registered a plurality of times in said first bill management table, wherein said second management table registers said discriminative information, the result information, and the transaction information from said first bill management table of which the information is rearranged in sequence of the discriminative information without duplication of the same the discriminative information, and wherein said discriminative information, the result information, and the transaction information are searchable by a processing means for tracing the bill.

5. The bill management system according to claim 4, wherein:

the bill handling apparatus further has an attendant-operable unit to be operated by an attendant; and said controller processes searching of the first bill management table and/or the second management table for information in accordance with an instruction from the attendant-operable unit.

6. The bill management system according to claim 4, wherein:

said controller judges whether the bill should be dispensed or not according to said discriminative information registered in said first bill management table and/or said second management table when the bill during dispensing has not been determined on true/false by said bill discriminator.

7. A bill management method for use in a bill handling apparatus, which handles bills each having an IC chip holding unique discriminative information, comprising:

recognizing the type of transaction to be done by each customer using the bill handling apparatus;

conveying bills over a conveying path for transactions with customers;

reading with a bill discriminator, installed on the conveying path, surface information on the conveyed bills and performing true/false determination of the bills;

reading with a wireless IC reader discriminative information held by the IC chips of the bills conveyed over the conveying path;

providing a first bill management table and a second management table in a memory unit;

storing in said first bill management table the discriminative information obtained from the IC chips through said wireless IC reader, information on a result of discrimination of bills through said bill discriminator, and transaction information including a type of transaction by the customer, the discriminative information, and the information on the result of discrimination being obtained every time the bill passes through said the wireless IC reader and said bill discriminator, wherein the same information can be registered a plurality of times in said first management table; and storing in said second management table said discriminative information, the result information and the transaction information from said first bill management table of which the information is arranged in sequence of the discriminative information without duplication of the same the discriminative information, wherein said discriminative information, the result information, and the transaction information are searchable by a processing means for tracing the bill.

8. The bill management method according to claim 7, wherein:

every time a bill passes the bill discriminator on the conveying path, the surface information and discriminative information of the bill are acquired and stored into said first bill management table to be distinguishable from previously acquired such information.

9. The bill management method according to claim 7, wherein:

an account number acquired from a card used by the customer and information regarding the time when the transaction was done are stored, being matched with the discriminative information.

10. The bill management method according to claim 7, further including an information searching step of searching for information stored in said first bill management table or said second management table by using the discriminative information as a key.

11. The bill management method according to claim 7, further including an information searching step of searching for information stored in the first bill management table and/or the second management table for information in accordance with an instruction from an attendant-operable unit.

12. The bill management method according to claim 7, further including a step of adding machine-specific information on the bill handling apparatus to information stored in said second management table and transmitting the resultant augmented information to a host computer to which the bill handling apparatus is connected.

13. The bill management method according to claim 7, further including a step of judging whether the bill should be dispensed or not according to said discriminative information registered in said first bill management table and/or said second management table when the bill during dispensing has not been determined on true/false by the bill discriminator.

* * * * *